United States Patent [19]

Murrah

[11] 4,135,439

[45] Jan. 23, 1979

[54] CARTON BOTTOM BREAKER

[75] Inventor: Howard E. Murrah, Fenton, Mich.

[73] Assignee: Ex-Cell-O Corporation, Troy, Mich.

[21] Appl. No.: 731,175

[22] Filed: May 5, 1977

[51] Int. Cl.[2] ..... B31B 1/52

[52] U.S. Cl. ..... 93/36.8; 53/378; 93/44.1 GT

[58] Field of Search ..... 93/36.8, 44.1 GT, 49 R; 53/374, 378, 379

[56] References Cited

U.S. PATENT DOCUMENTS

| | | | |
|---|---|---|---|
| 3,196,760 | 7/1965 | Terry | 93/44.1 GT |
| 3,239,995 | 3/1966 | Monroe et al. | 93/44.1 GT X |
| 3,593,625 | 7/1971 | Garrett et al. | 93/44.1 GT X |

*Primary Examiner*—James F. Coan

*Attorney, Agent, or Firm*—Mitchell J. Hill

[57] ABSTRACT

A carton bottom breaker for performing a prebreaking operation on the panels of a bottom closure structure of a coated paperboard carton mounted on a carton forming mandrel. A movable carrier member has a V-shaped breaker means fixed thereon which comprises a pair of outwardly sloping folder plates for operative engagement with the fold-over panels of the bottom closure of a carton. A spring biased V-shaped breaker plate member is movably mounted on the carrier member between the sloping folder plates in a plane transverse to the V-shape formed by the folder plates, and it is adapted to engage the fold-in panels of the bottom closure of a carton. A mandrel stop finger is carried by the V-shaped breaker plate member for abutment with the carton mandrel, in an off-center position, to prevent damage of the mandrel by engagement with the V-shaped breaker means and V-shaped breaker member.

4 Claims, 5 Drawing Figures

CARTON BOTTOM BREAKER

BACKGROUND OF THE INVENTION

1. Field of the Invention

This invention relates to coated paperboard carton forming machines, and generally, to a carton bottom end closing means for these machines. The invention is particularly concerned with a carton bottom breaker apparatus that is adapted to carry out a prebreaking operation upon the bottom closure panels of a carton prior to the tucking and sealing of these panels.

2. Description of the Prior Art

It is well known in the coated paperboard carton forming art to provide a forming machine with apparatus for performing a prebreaking operation on the bottom end closure panels of a coated paperboard carton. Some of the prior art paperboard carton forming machines also include apparatuses which eliminate a separate prebreaking operation upon the bottom end closure panels and which have end folding and tucking apparatuses for closing the bottom end panels of a carton. A disadvantage of the aforementioned prior art bottom end folding and tucking apparatuses, whether eliminating separate prebreaking operations or not, is that they are relatively expensive, due to their complex construction which incorporates a plurality of drive means for operating the various required folding and tucking elements. A further disadvantage of the aforementioned prior art carton bottom end forming apparatuses is that they sometimes fail to properly fold the bottom end closure panels along the score lines dividing these panels which results in false scoring, and folding of the panels incorrectly with resultant defective and leaking bottom end closures.

SUMMARY OF THE INVENTION

In accordance with the present invention, the carton bottom end breaker apparatus is operatively supported by a suitable means for movement upwardly and downwardly relative to a carton mounted on a mandrel that is carried on a rotating turret, or like apparatus, of a carton forming machine, as for example, by an adjacently disposed heater mechanism which is movable upwardly and downwardly for providing a heating operation upon a carton disposed on an adjacent mandrel. The carton bottom end breaker apparatus of the present invention is especially adapted to operate on a carton which does not have any tuck-in flap but which is provided with a straight butt flap on one of the bottom end closure panels so as to overlap the adjacent bottom end closure panel, and wherein the straight butt flap is disposed during a prebreaking operation in the direction of travel of the carton along the carton forming path.

The carton bottom end breaker apparatus of the present invention includes a vertically disposed V-shaped pressure plate which is positioned parallel to the aforementioned straight butt flap of the carton so that when the breaker apparatus is moved upwardly into operative engagement with a carton, the pressure plate engages the leading and trailing fold-in panels of the bottom end closure structure and folds them inwardly along the diagonal score lines. An upwardly and outwardly sloping folder member is mounted on each side of the V-shaped pressure plate on a carrier member so as to form a second V-shaped structure which is disposed perpendicular to the V-shape of the pressure plate and which functions to engage the outer surfaces of the two major bottom end fold-over closure panels and fold them inwardly about their respective score lines at about a 45° angle into close contact with the mandrel. The main pressure plate is spring loaded to permit the pressure plate to move relative to the carrier member and sloping folder members during a bottom end breaking operation to insure infold of the leading and trailing triangular fold-in panels and diagonal fold under panels. The pressure plate also is provided with a stop finger for engagement with the lower surface of a carton forming mandrel, and for contact with said mandrel at a point offset from any sealing area on the mandrel so as not to damage the mandrel in a sealing area.

The bottom end breaker apparatus of the present invention forces the bottom end panels to properly and positively break across their respective score lines so as to force the corners of the bottom closure structure to fold in at the proper point instead of breaking down and false scoring or folding below the score line. It also forces the diagonal corners of the folded in diagonal panels to be properly formed. The bottom end closure apparatus provides a breaker operation which results in reasonably sharp breaks in all four corners of a bottom end closure structure so that the bottom end closure structure will fold up reasonably square instead of pulling out during a final bottom end closing and sealing operation and to provide a leak-proof tight seam across a closed bottom end closure.

The stop finger also functions as a safety finger in a situation wherein a carton is not mounted on a mandrel when the bottom end breaker apparatus is moved upwardly into an operative position, whereby the stop finger comes into contact with the bottom of the mandrel in an uncritical location so as not to mar the mandrel in any sealing area and damage the same for later operations. The stop finger also prevents the V-shaped pressure plate from coming into contact with the corners of a mandrel in the event that there is no carton mounted on the mandrel and so prevent damage to the corners of the mandrel.

It will be seen that the carton bottom end breaker apparatus of the present invention provides a simple, compact and more economical apparatus than is provided by the corresponding prior art apparatuses, and that it also provides a positive breaking of the bottom closure panels along their respective score lines.

Other objects, features and advantages of this invention will be apparent from the following detailed description, appended claims, and the accompanying drawings.

DESCRIPTION OF THE PREFERRED EMBODIMENT

Figure 1:
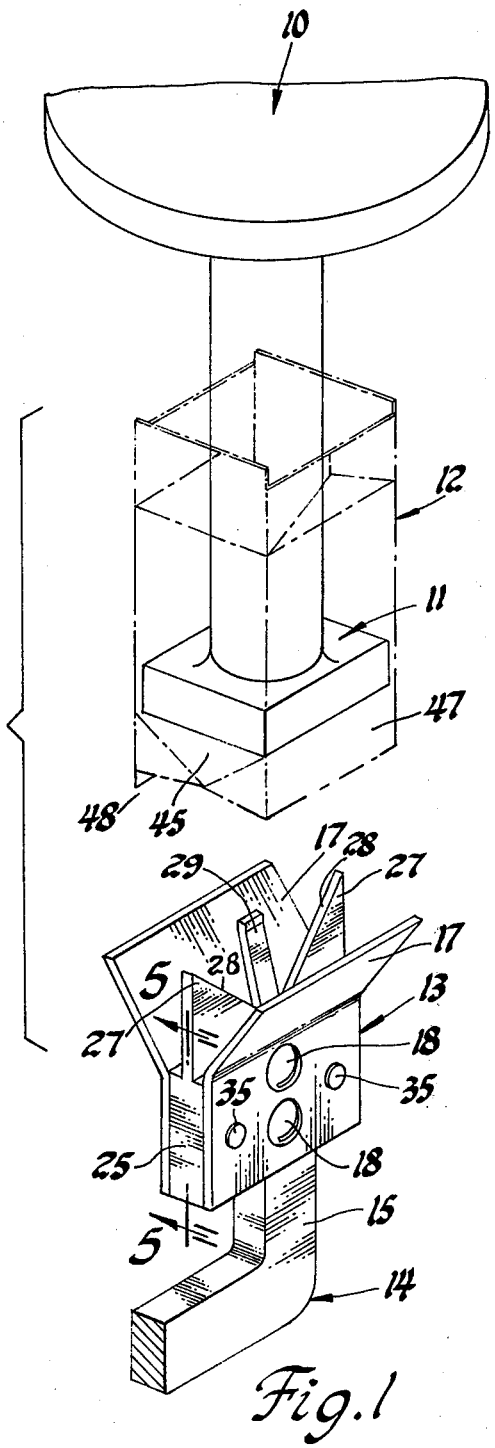
FIG. 1 is a perspective elevation view of a carton bottom breaker apparatus made in accordance with the principles of the present invention and showing it positioned beneath a carton prior to a bottom breaker operation.

Referring now to the drawings, and in particular to FIG. 1, the numeral 10 schematically represents a rotating turret in a carton packaging machine which carries carton forming mandrels, of the type generally indicated by the numeral 11, on which are mounted expanded carton blanks 12 for forming into a container with a closed bottom. The numeral 13 in FIG. 1 generally designates a carton bottom breaker made in accordance with the principles of the present invention, and which is adapted to be moved upwardly and downwardly for performing a prebreaking operation on the bottom closure panels of a carton 12 on the mandrel 11 of the turret 10.

Figure 4:
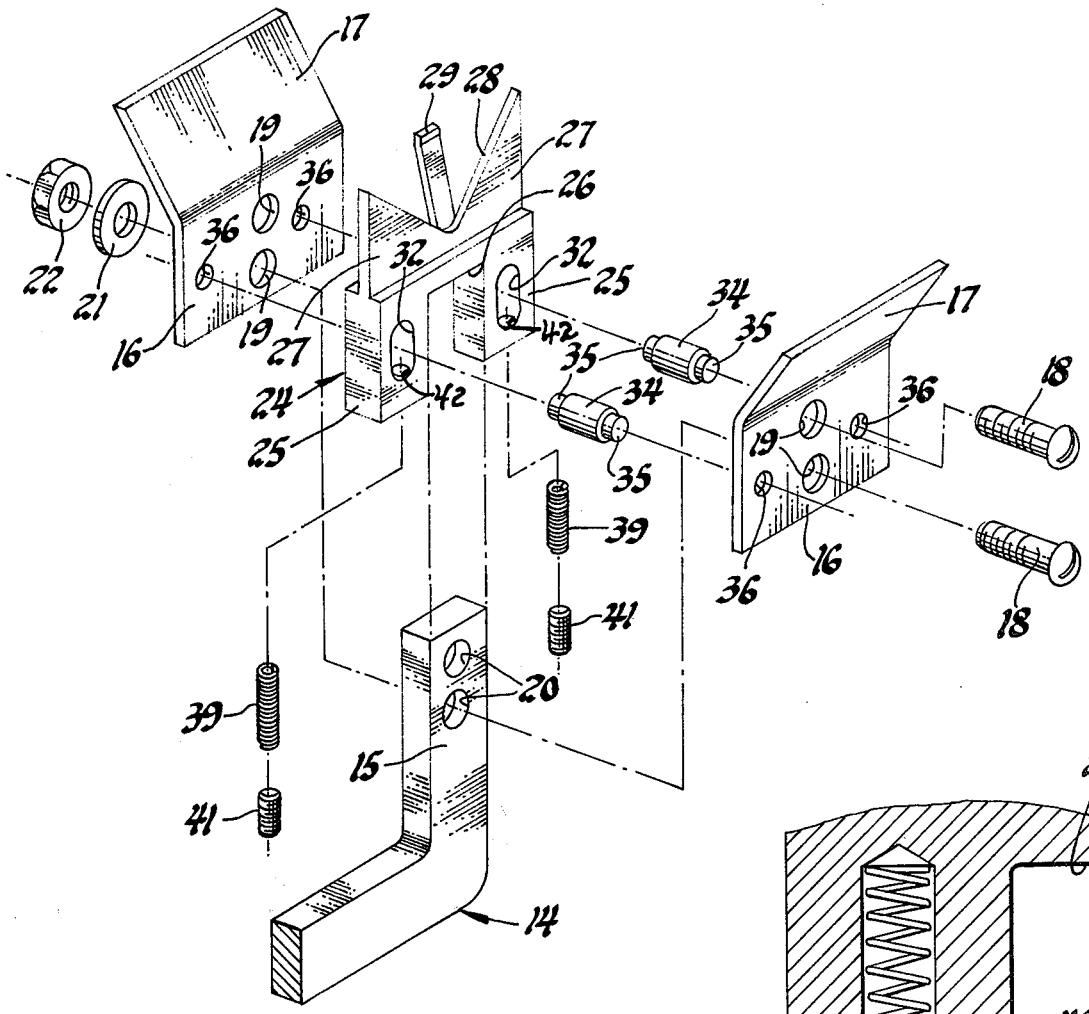
FIG. 4 is a perspective exploded view of the carton bottom breaker apparatus illustrated in FIGS. 1 through 3.

As best seen in FIGS. 1 and 4, the carton bottom breaker 13 comprises a carrier member, generally indicated by the numeral 14, which has a horizontally extended arm portion that is adapted to be connected to an adjacent movable mechanism on a carton packaging machine for moving the bottom breaker upwardly and downwardly, as for example, an adjacently disposed heater mechanism. The carrier member 14 further includes an integral vertical arm 15. The upper end of the carrier member arm 15 is adapted to be slidably mounted in a rectangular recess 26 which is centrally formed in the bottom side of a pressure plate body, generally indicated by the numeral 24. The recess 26 divides the pressure plate body 24 into two spaced apart vertical portions 25, so as to form an inverted U-shaped pressure plate body. The pressure plate body 24 is movably mounted relative to the carrier arm 15, as described hereinafter.

Figure 2:
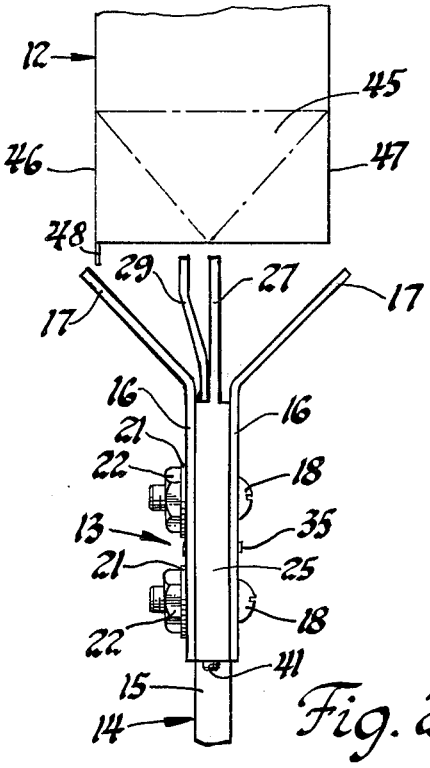
FIG. 2 is an end elevation view of the carton bottom breaker apparatus illustrated in FIG. 1, and showing the apparatus in a retracted inoperative position.

A pair of sloping folder plates or steeple breakers 17 having integral vertical mounting plate portions 16 are fixedly secured to opposite sides of the carrier member vertical arm 15. The last mentioned mounting plate portions 16 are secured to the carrier arm 15 by suitable machine screws 18 which extend through bores 19 formed through the mounting plate portions 16 and bores 20 formed through the carrier arm 15. As shown in FIG. 2, the machine screws 18 are secured in place by suitable washers 21 and lock nuts 22. As shown in FIG. 2, the sloping folder plates 17 extend upwardly and outwardly so as to diverge and form a V-shaped breaker means for operative engagement with the fold-over panels 46 and 47 of a carton 12 during a pre-breaking operation.

As best seen in FIG. 4, the pressure plate body 24 has provided on the upper side thereof a pair of integral diagonal breaker members 27. The diagonal breaker members 27 comprise a pair of integral pressure plate members which are formed on the upper side of the body portion 24, and which are triangular in shape. The diagonal breaker members have vertical outer edge surfaces, and inwardly converging and downwardly extended inner edge surfaces 28 to form a V-shaped breaker plate. A mandrel stop finger 29 is carried by the pressure plate body 24. The diagonal breaker members 27 and the pressure plate body 24 comprise what may be termed a V-shaped breaker plate member or a fold-in panel breaker means. The sloping folder plates 17 and integral mounting plate portions 16 comprise what may be termed a fold-over panel breaker means or a V-shaped breaker means.

Figure 5:
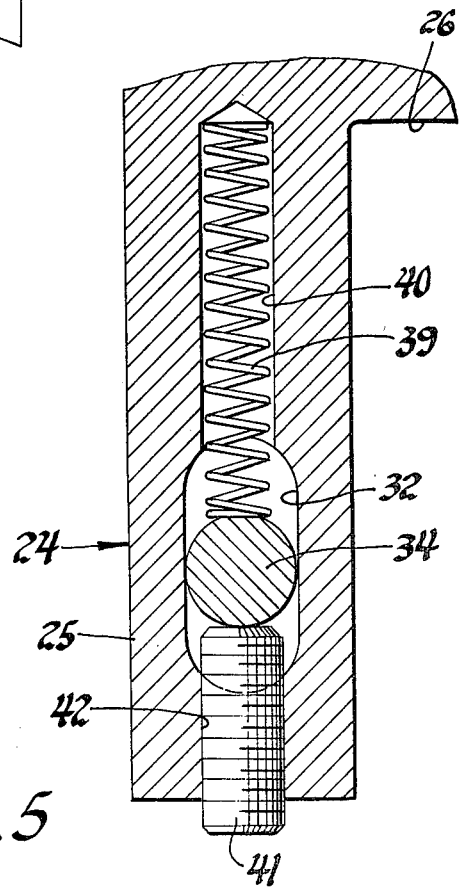
FIG. 5 is a fragmentary, enlarged, elevation section view of the carton bottom breaker apparatus illustrated in FIG. 1, taken along the line 5—5 thereof, and looking in the direction of the arrows.

As shown in FIGS. 4 and 5, a vertically disposed, elongated spring slot 32 is formed in each of the pressure plate body portions 25, on opposite sides of the carrier arm 15. A spring bore 40 communicates at its lower end with each of the slots 32, and it extends upwardly in each respective body portion 25. A cylindrical spacer and spring stop member 34 is slidably mounted in a transverse position in each of the slots 32. Each of the spacer and spring stop members 34 is provided with an integral reduced diameter end 35, on each end thereof, which protrudes out from the respective slot 32 and into slidable engagement in a slot 36 in the adjacently disposed mounted plate portion 16. A return spring 39 is mounted in each of the spring bores 40, and its lower end engages the upper side of the spacer and spring stop member 34 in the adjacent slot 32. The upper end of each of the return springs 39 abuts the upper end of its respective recess 40.

As shown in FIG. 4, each of the pressure plate body portions 25 is provided with a threaded bore 42, in the lower end thereof, which extends inwardly into communication with the lower end of the adjacent elongated slot 32. An adjusting screw 41 is threadably mounted in each of the bores 42 for exerting a pressure on the spacer and spring stop members in the slots 32, and in turn exerting a pressure on the spring 39 in each of the slots 40. It will be seen that the springs 39 provide a normal upward bias on the pressure plate body 24, so that the diagonal breaker members 27 engage the fold-in panels 45 of a carton before the folder plates 17 engage the fold-over panels 46 and 47.

Figure 3:
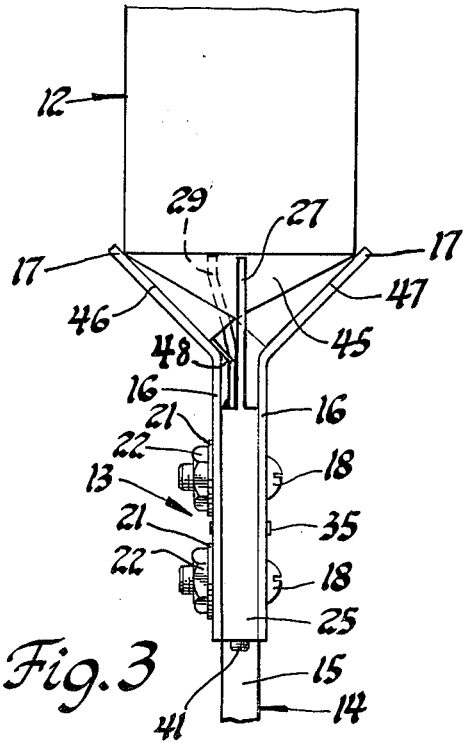
FIG. 3 is a view similar to FIG. 2, and showing the carton bottom breaker apparatus in a raised operative position.

In use, the carrier member arm 14 is moved upwardly by an attached mechanism, such as a heater mechanism, so as to bring the spring loaded diagonal breaker members 27 into contact with the carton fold-in panels 45 before the folder plates 17 engage the fold-over panels 46 and 47. The bottom breaker 13 is moved from a bottom breaker "down" position as illustrated in FIG. 2, to a bottom breaker "up" position. The diagonal breakers 27 break the two diagonal scores on each side of the fold-in panels 45 so as to force these two diagonal panels inwardly so that they will fold properly. The sloping folder plates 17 fold the fold-over panels 46 and 47 inwardly to about a 45° angle, as shown in FIG. 3. The fold-over panels 46 and 47 are forced to break in at the corners and fold-up square instead of breaking down and false scoring below the score lines in the carton blank. The breaking of the fold-over panels 46 and 47 also forces the diagonal corners to form properly. The pre-breaking operation performed on the bottom closure panels of a carton provides a carton which will fold tight and perfectly flat on the bottom thereof, so as to provide a tight seam across the bottom closure when the bottom closure is closed and sealed.

The mandrel stop finger 29 contacts the bottom of the mandrel 11 when the bottom breaker 13 is in the raised, operative position as shown in FIG. 3, so as to prevent the two diagonal breakers 27 from coming up and contacting the bottom of the mandrel 11 and causing injurious wear on the corner of the mandrel 11 in the event that there is no carton 12 mounted on the mandrel 11. The spring loading of the pressure plate body 25 allows for a certain amount of over-travel of the bottom breaker 13. The stop finger 29 is adapted to engage the bottom of the mandrel 11 in an off-center position, that is an area which is not used for sealing, so that the bottom area of the mandrel against which a sealing function is performed is not marred. It will be seen that the carton bottom breaker 13 of the present invention is a simple, inexpensive and effective apparatus for performing a prebreaking operation on the bottom closure of a carton to ensure that the carton bottom closure panels will fold properly along their score lines, and prevent false scoring and a leaky bottom closure when the bottom closure panels of a carton are closed and sealed.

While it will be apparent that the preferred embodiment of the invention herein disclosed is well calculated to fulfill the objects above stated, it will be appreciated that the invention is susceptible to modification, variation and change.

What is claimed is:

1. In a carton bottom breaker apparatus for performing a pre-breaking operation on the fold-over and fold-in panels of the bottom closure structure of a coated paperboard carton mounted on a carton mandrel, the combination comprising:

(a) a movable carrier member disposed under the mandrel;

(b) a fold-in panel breaker means movably mounted on said carrier member;

(c) a fold-over panel breaker means fixedly mounted on said carrier member whereby when the carrier member is moved upwardly toward the mandrel, the fold-in panel breaker means and the fold-over panel breaker means engage said panels and force them upwardly into close contact with the mandrel, thereby causing the panels to break along their score lines;

(d) said fold-in panel breaker means is provided with spring means for normally biasing the fold-in panel breaker means upwardly above the fold-over panel breaker means so that the fold-in panel breaker means engages the fold-in panels before the fold-over panels are engaged by the fold-over panel breaker means;

(e) a mandrel stop finger carried by said fold-in panel breaker means for engagement with the bottom end of the mandrel to limit the movement of the fold-in panel breaker means toward the mandrel;

(f) a V-shaped breaker plate member that is disposed in a vertical plane transverse to the planes of the fold-in panels;

(g) a V-shaped breaker means that is perpendicularly disposed relative to the plane of the fold-in panel V-shaped breaker plate member;

(h) a pair of sloping folder plates which are mounted on opposite sides of the movable carrier member with the V-shaped breaker plate member being intermediately disposed therebetween;

(i) a first plate portion fixedly secured to said movable carrier member;

(j) an integral second portion which diverges sideward outwardly from the intermediately disposed V-shaped breaker plate member;

(k) a pair of vertically extended elongated slots formed in the body portion of the V-shaped breaker plate member, in each of which is movably mounted a spacer and spring stop member;

(l) each of said spacer and spring stop members having reduced diameter end portions which are fixed to the first plate portions of the sloping folder plates; and, (m) a spring mounted in each of said elongated slots above the spacer and spring stop member, and having one end engaging said stop member and the other end engaging the upper end of the slot in the V-shaped breaker plate member body portion for normally biasing the V-shaped breaker plate member in an upward direction relative to the carrier member.

2. A carton bottom breaker apparatus as defined in claim 1, including:

(a) means for adjusting the pressure of the springs for adjusting the position of the V-shaped breaker plate body portion relative to the sloping folder plates.

3. A carton bottom breaker apparatus as defined in claim 2, wherein said means for adjusting the pressure of each of the springs comprises:

(a) a set screw threadably mounted below each of the elongated slots in the V-shaped breaker plate member, and having one end extended into the adjacent slot and into abutting engagement with the spacer and spring stop member in the slot for moving said stop member to adjust the pressure on the spring in the slot.

4. In a carton bottom breaker apparatus for performing a pre-breaking operation on the fold-over and fold-in panels of the bottom closure structure of a coated paperboard carton mounted on a carton mandrel, the combination comprising:

(a) a movable carrier member disposed under the mandrel;

(b) a fold-in panel breaker means movably mounted on said carrier member;

(c) a fold-over panel breaker means fixedly mounted on said carrier member, whereby when the carrier member is moved upwardly toward the mandrel, the fold-in panel breaker means and the fold-over panel breaker means engage said panels and force them upwardly into close contact with the mandrel, thereby causing the panels to break along their score lines;

(d) said fold-in panel breaker means is provided with spring means for normally biasing the fold-in panel breaker means upwardly above the fold-over panel breaker means so that the fold-in panel breaker means engages the fold-in panels before the fold-over panels are engaged by the fold-over panel breaker means;

(e) a mandrel stop finger carried by said fold-in panel breaker means for engagement with the bottom end of the mandrel to limit the movement of the fold-in panel breaker means toward the mandrel;

(f) a V-shaped breaker plate member that is disposed in a vertical plane transverse to the planes of the fold-in panels;

(g) a V-shaped breaker means that is perpendicularly disposed relative to the plane of the fold-in panel V-shaped breaker plate member;

(h) a pair of sloping folder plates which are mounted on opposite sides of the movable carrier member with the V-shaped breaker plate member being intermediately disposed therebetween;

(i) a first plate portion fixedly secured to said movable carrier member;

(j) an integral second portion which diverges sideward outwardly from the intermediately disposed V-shaped breaker plate member;

(k) a body portion slidably mounted on said movable carrier member;

(l) a pair of integral pressure plate members formed on the upper side of the body portion which are triangular in shape and which have vertical outer edge surfaces and inwardly converging and downwardly extended inner edge surfaces to form a V-shaped breaker plate;

(m) said mandrel stop finger is fixedly mounted on said V-shaped breaker plate member body portion in a central position between the pair of integral pressure plate members; and (n) said mandrel stop finger has a lower end fixed to said V-shaped breaker plate member and a body portion extended upwardly therefrom and sloping sideward outwardly in a diverging manner so that the upper end thereof is adapted to engage the lower end of a carton mandrel in an off-center position.

* * * * *